United States Patent [19]

Ellman et al.

[11] 4,023,816

[45] May 17, 1977

[54] INFLATABLE TOY

[76] Inventors: Julius Ellman, 1672 E. Seventh St., Brooklyn, N.Y. 11230; George Lerner, 12 Prospect Court, Freeport, N.Y. 11520

[22] Filed: Oct. 28, 1975

[21] Appl. No.: 626,112

[52] U.S. Cl. ..... 280/1.13

[51] Int. Cl.[2] ..... A63G 19/00

[58] Field of Search ..... 280/1.1 R, 1.11 R, 1.13, 280/1.208, 1.22, 87.01, 87.02 R, 87.03, 87.05; 272/52

[56] References Cited

UNITED STATES PATENTS

| | | | |
|---|---|---|---|
| 3,065,567 | 11/1962 | Lemelson | 280/1.208 X |
| 3,712,634 | 1/1973 | Simmons | 280/1.208 X |
| 3,791,662 | 2/1974 | Glass | 280/1.1 R |

*Primary Examiner*—Joseph F. Peters, Jr.
*Assistant Examiner*—R. Schrecengost
*Attorney, Agent, or Firm*—Paul J. Sutton

[57] ABSTRACT

A rollable, inflatable toy that may be ridden by a human, such as a child, is disclosed. The toy comprises a hollow body portion having a forward end, a rearward end and an intermediate portion that is shaped so as to support a child thereon. An inlet to the interior of the hollow body portion is provided so that it may be inflated and deflated at will. Secured to the underside of the hollow body portion, at the forward and rearward ends thereof, are rollable carriages that are comprised of transverse axles at the outer ends of which are mounted wheels. Transverse channels may be made integral with the axles in order to minimize the bending thereof. In addition, at the ends of each channel, a wheel cover is provided for at least partially covering the upper portion of each wheel. Because the hollow body portion is flexible, it will bend when a child sits thereon, thereby simulating the actual riding of a horse, for example, without the need for springs and linkages or the like. The wheels provide the necessary mobility for the toy.

12 Claims, 9 Drawing Figures

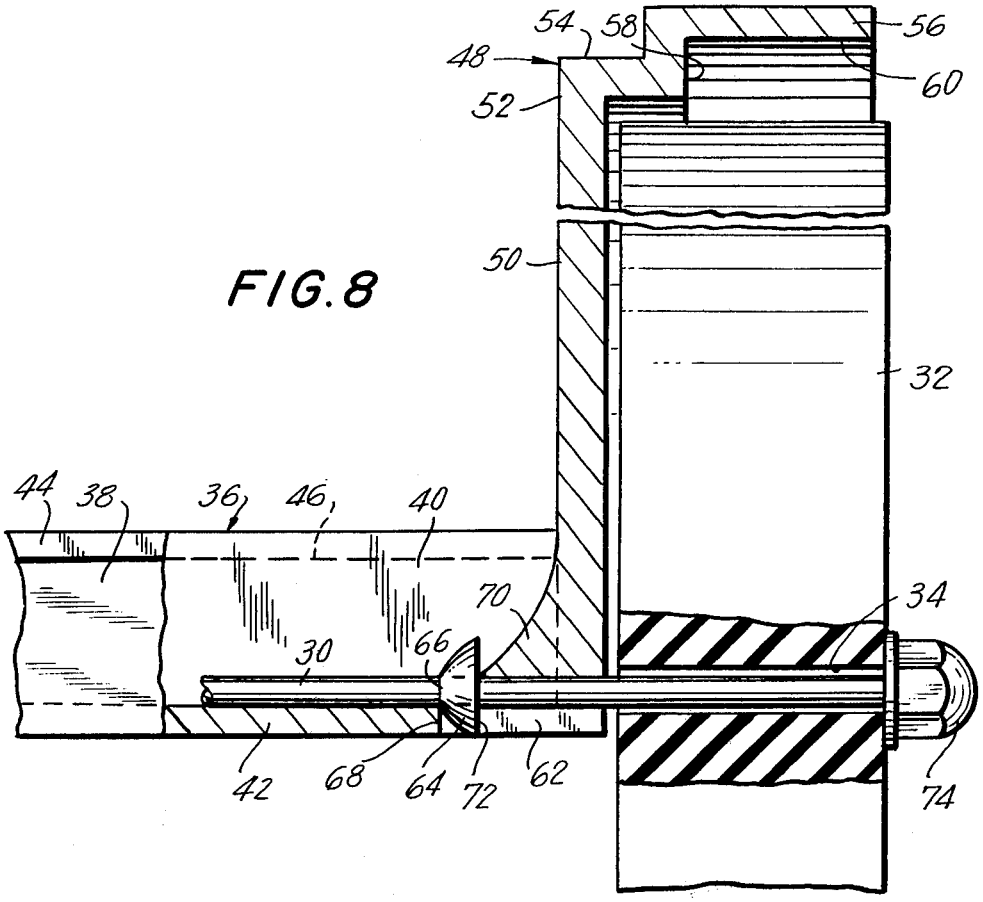
FIG. 8
FIG. 9
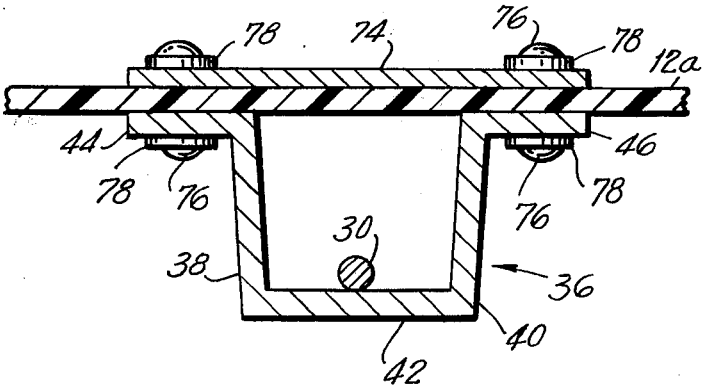

INFLATABLE TOY

The present invention relates generally to the toy arts and more particularly to an inflatable, rollable toy that may be ridden by a child.

There are many examples in the patent literature illustrating prior art structures for rideable toys that are mobile via the provision of wheels. Still other examples of the prior art disclose inflatable toys that are relatively stationary or at least cannot function with wheels. There does not appear to be any prior art structure that discloses an inflatable toy that may be moved about on wheels with a child sitting thereon, as disclosed.

One example of a rollable prior art toy is disclosed in U.S. Pat. No. 2,015,974 granted to B. F. Stannard on Oct. 1, 1935. The Stannard toy provides a horse-shaped body portion which is supported by leg-like members having wheels at the lower ends thereof. Springs extend between the leg-like members so that when a child is seated thereon the legs spread fore and aft and the body portion is thereby lowered. It should be noted, however, that in this example of the prior art, the body portion is rigid and is not inflatable.

Another example of the prior art in which a rigid, non-inflatable body portion is provided is disclosed in U.S. Pat. No. 2,997,299, granted to C. Wilkins, Jr. on Aug. 22, 1961. A plurality of floats are provided at the ends of four outriggers which are, in turn, secured to the rigid body portion. This example of the prior art, which includes a rigid body portion, is designed to support a child in a relatively stable condition in water and to also provide an improved pitching and rolling movement. In this example of the prior art, the body portion is rigid and not inflatable and the floats are not comparable to wheels that are used to move about on a hard surface.

Still another example of the prior art is disclosed in U.S. Pat. No. 3,298,702, granted on Jan. 17, 1967 to P. P. Rademacher. There is disclosed in this last-mentioned U.S. Patent a rigid or solid body portion which is supported by spring-like members on a rigid frame that includes a plurality of rollable casters. The spring like members simulate a galloping, bucking and rearing action in the same manner as the first-described example of the prior art. However, it will be appreciated, that in the Rademacher patent the body portion is neither flexible nor inflatable.

Yet another example of the prior art is disclosed in U.S. Pat. No. 2,725,237, granted to H. C. Feist on Nov. 29, 1955. The Feist patent discloses a rigid, non-inflatable body portion on which a child may be seated. A plurality of legs extend downwardly from the body portion and are provided with wheels at the lower ends thereof. The rearward legs are spring-biased with respect to the body portion in order to simulate the hopping gait of a horse. While the toy in the Feist patent is mobile, it will be evident that the patentee did not contemplate a flexible, inflatable body portion.

Another example of a hobby horse is disclosed in U.S. Pat. No. 3,122,377, granted on Feb. 25, 1964 to H. A. Mortenson. There is disclosed therein a mobile hobby horse having resilient mounting feet that can closely simulate both a galloping motion and the bucking movements of a horse. To provide the requisite motion, one embodiment of the Mortenson patent utilizes an inflatable, balloon-like member for the feet and, in another embodiment, provides a spring in the ball-like foot. The Mortenson patent does not teach either a rollable toy or a toy having an inflatable body portion.

A further example of the prior art in this general field is disclosed in U.S. Pat. No. 2,968,337, granted on Jan. 17, 1961 to G. H. Bartlett. A frame member having rollable wheels thereon is provided with a leaf spring which supports the body portion of the toy. When a child sits on the body portion of the toy the leaf spring is deflected and will thereby propel the toy on the wheels along the floor. It will be evident that the concept of a combination inflatable and rollable toy is not suggested in the Bartlett patent.

Yet another example of the prior art toy literature is disclosed in U.S. Pat. No. 2,884,247, granted to B. B. Johns on Apr. 28, 1959. A body portion is mounted on a ground-engaging element which is spring-biased with respect to the body portion so that there is a simulation in action of the physical movements of a bucking bronco. There is no suggestion, however, of either an inflatable, rideable toy or a plurality of rollable wheels for supporting the toy for movement along a floor.

An example of an inflated toy is disclosed in U.S. Pat. No. 1,846,393, granted on Feb. 23, 1932 and issued to L. S. Hankins. The patentee provides an inflatable toy that is shaped to the configuration of certain well-known animated bodies such as horses, cows, cats, dogs, fowl, fish or serpents. The toy is not inflatable in sense of the present invention in that it is filled with material such as sawdust, cotton, excelsior or the like. The filling is tightly packed within the hollow body portion and provides sufficient rigidity to support the weight of a small child. In the Hankins patent, no rollable wheels are provided. Nor is the toy deflatable and easily shipped in the sense of the present invention.

A truly inflatable toy is disclosed in U.S. Pat. No. 3,098,317, granted on July 23, 1963 to G. G. Guzman. In this last-mentioned patent, a hollow, inflatable body portion is provided having hollow legs extending downwardly therefrom to a hollow base. The entire structure is intended to be inflated sufficiently so as to support the weight of a child. When the child is seated on the toy, the flexible and resilient hollow body will simulate the motions of a bronco horse when the child bounces up and down since the legs of the toy are capable of being compressed. However, the base is made of a non-skid material and is relatively stationary with the requisite lateral and longitudinal flexing being provided by the flexible legs. While the toy disclosed in the Guzman patent is inflatable, it will be appreciated that it is not rollable as intended by the present invention.

Finally, another inflatable toy is disclosed in U.S. Pat. No. 2,665,519, granted on Jan. 12, 1954 to A. Burkes. In this last-mentioned patent, the toy, which is inflatable, simulates a riding animal and may be used either on land or on water. However, the patentee does not provide wheels that permit the toy to be rolled on land.

The present invention contemplates the elimination of the limitations and disadvantages of conventional solutions to recognize the needs of the art by providing novel apparatus. Accordingly, it is an object of my invention to provide a novel, inflatable toy that may be ridden on and which may be rolled on a hard surface.

A further object of the present invention is to provide an improved toy, as described above, which simulates the riding action of a horse.

A still further object of the present invention is to provide a novel toy, as described above, which is of very simple construction and readily lends itself to efficient and inexpensive mass production and which is sufficiently strong and rigid in its inflated form to safely hold a youngster's weight without collapsing.

An additional object of the present invention is to provide an improved rideable and inflatable toy, as described above, in which the toy is supported on wheels which are journalled in carriages that are secured to the underside of the hollow body portion approximate the forward and rearward ends thereof.

Yet another object of the present invention is to provide an improved inflatable and rollable toy, as described above, wherein rigid channel means are utilized for the carriage assemblies in which the wheels are rotatably journalled.

It is still another object of the present invention to provide an improved, rollable toy, as described above, that may be readily inflated and deflated, so as to be easily transported in a volumetric state far less than the state in which it is used.

The present invention fulfills the above objects and overcomes limitations and disadvantages of prior art solutions to problems by providing, according to one aspect of the present invention, a novel structure that permits a toy to be safely ridden while rolling on a hard surface. The present invention provides a hollow body portion that may be inflated by means of a valve. The body portion is provided with a forward end, a rearward end and an intermediate central portion that is shaped so that a child may sit thereon. Rollable carriage assemblies are secured to the underside of the hollow body portion proximate the forward and rearward ends thereof. The carriage assemblies are comprised of an elongated, transversely oriented axle having a wheel mounted at each end thereof and channel means integral with each axle for minimizing the bending thereof when a child is seated on the toy. The channel of each carriage assembly is defined by an elongated, transversely oriented U-shaped member defined by laterally spaced apart and generally parallel legs and an integral, generally transversely oriented connecting leg. The axle is secured longitudinally on the connecting leg of the channel while the free end of the laterally spaced apart legs of the channel may each be provided with an outwardly directed flange. Wheel covers may also be included at the ends of each channel for at least partially covering each of the wheels. In addition, means are provided for limiting axial displacement of the axles in each carriage assembly.

The invention will be more clearly understood from the following description of a specific embodiment of the invention together with the accompanying drawings wherein similar reference characters denote similar elements throughout the several views and in which:

FIG. 8 is a fragmentary, hollow longitudinal sectional view taken along line 8 — 8 of FIG. 6; and FIG. 9 is a transverse, cross-sectional elevational view illustrating one form of structure for securing a carriage assembly of the present invention to the body portion thereof.

Figure 1:
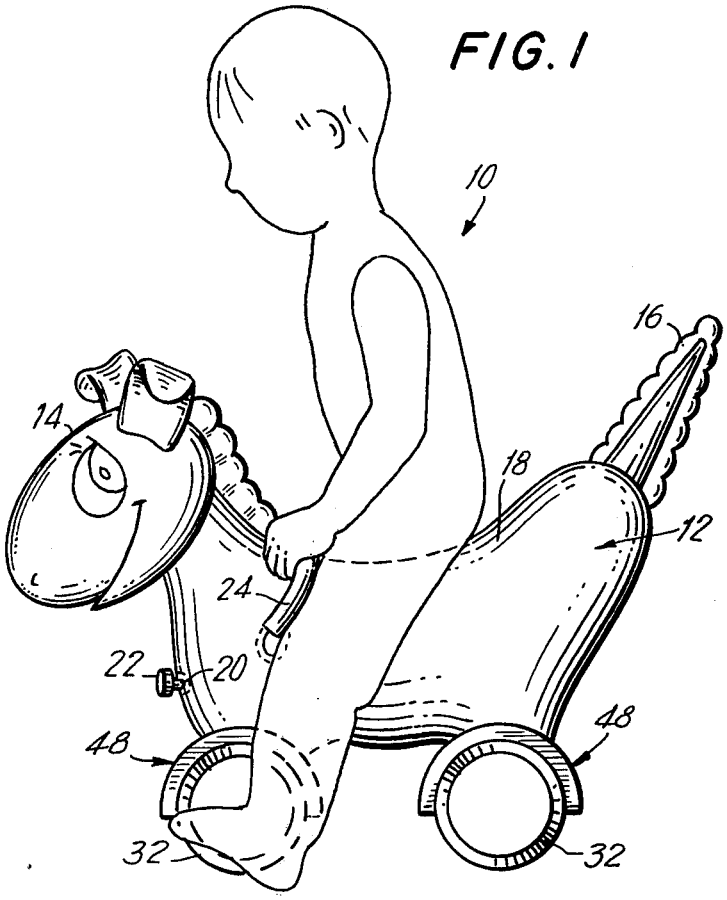
FIG. 1 is a side elevational view of the toy comprising the present invention with a child shown seated thereon but without the weight of the child being applied to the toy.
Figure 3:
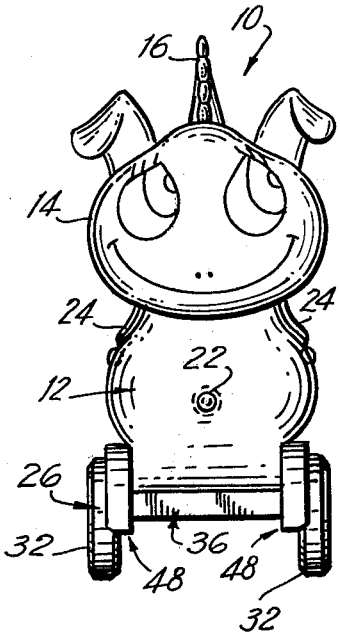
FIG. 3 is a front elevational view of the toy comprising the present invention.
Figure 2:
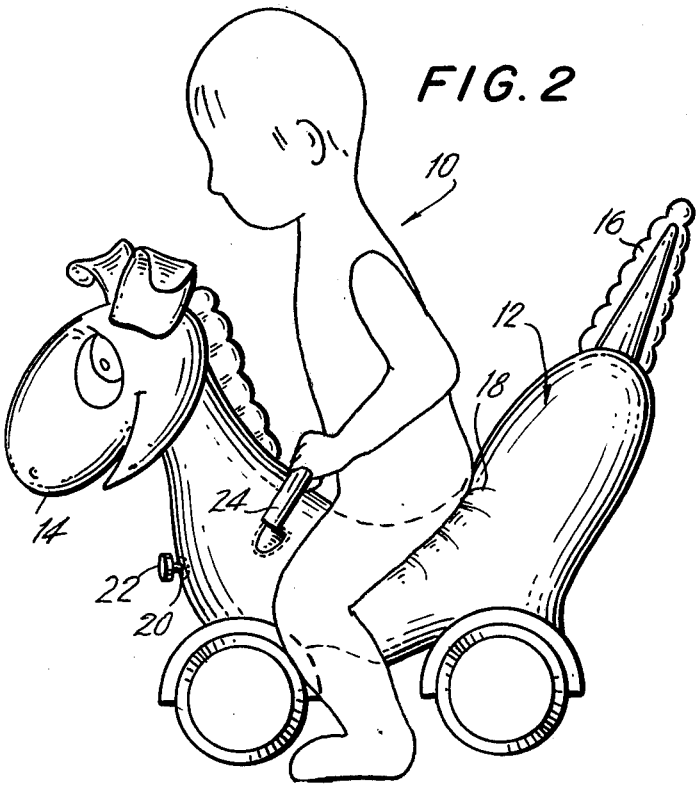
FIG. 2 is a side elevational view similar to FIG. 1, but with the weight of the child being applied to the central section of the body portion.
Figure 4:
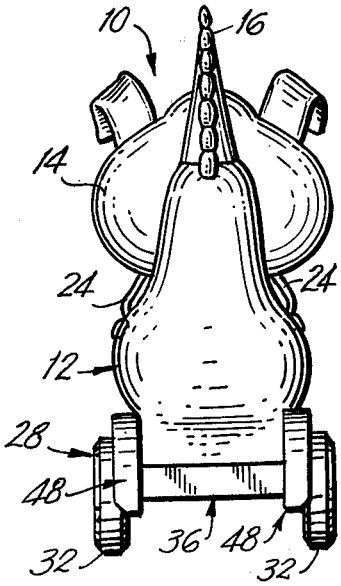
FIG. 4 is a rear elevational view of the toy comprising the present invention.

Referring now in more detail to the drawings, there is shown for example in FIGS. 1 – 5, a rollable, inflatable toy 10 comprising the present invention. The toy 10 is comprised of a body portion generally designated by the reference character 12, which body portion 12 may be made of any suitable plastic material and which includes a forward end 14, a rearward end 16 and a central portion 18 that is shaped so that a child may sit thereon. Preferably, the toy 10 is shaped as a three-dimensional caricature of a horse. Inflation means in the form of a tubular stem 20 and a closure cap 22 therefor is provided for filling the hollow body portion 12 with air. The body portion is further provided with a pommel 24 that the child may grasp.

Figure 5:
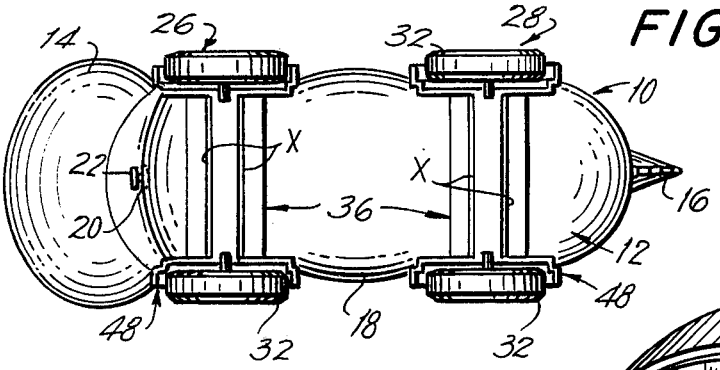
FIG. 5 is a bottom plan view of the toy comprising the present invention.
Figure 6:
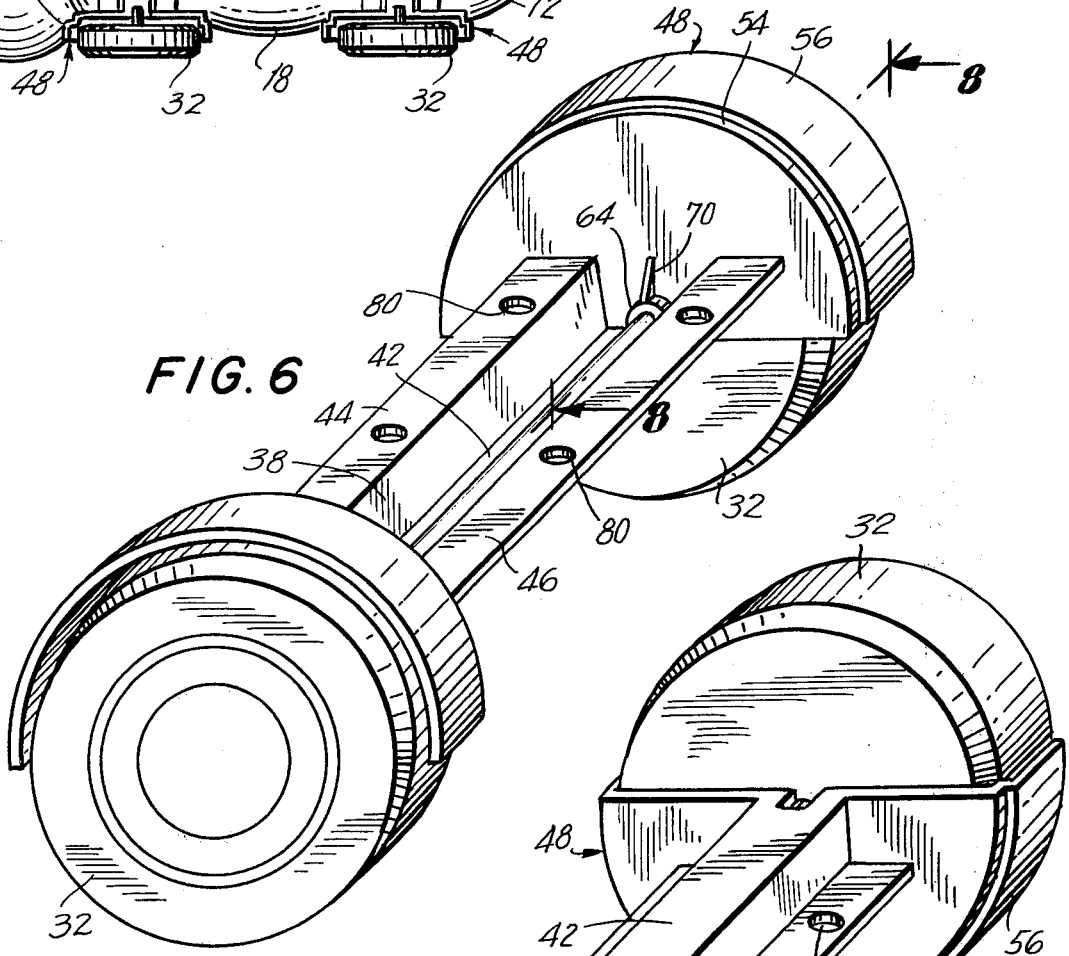
FIG. 6 is a perspective view, from the top, illustrating a typical carriage assembly utilized with the present invention.
Figure 7:
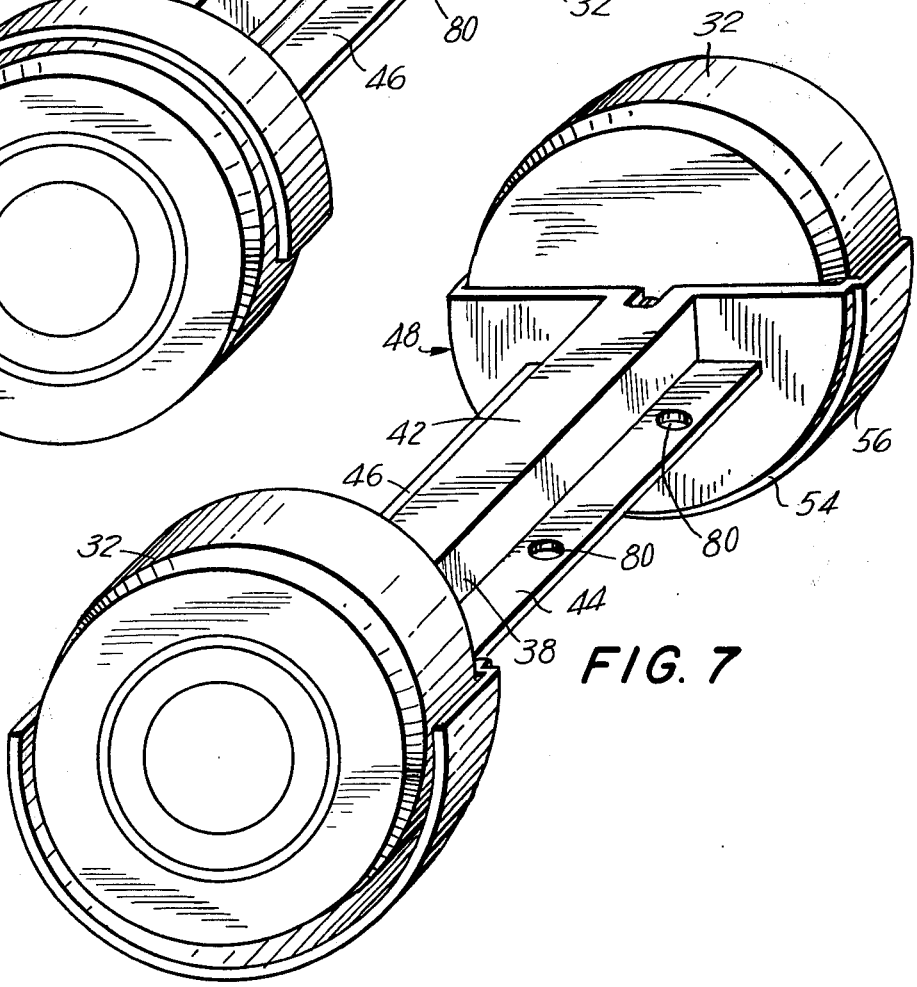
FIG. 7 is a perspective view similar to FIG. 6, but illustrating the underside of a typical carriage assembly.

In order to rollably support the toy 10 there are provided forward and rearward carriage assemblies generally designated by the reference characters 26 and 28, respectively, such as shown for example in FIG. 5. Since both carriage assemblies 26 and 28 are identical, only one will be described, and for this purpose, reference may be had to FIGS. 6, 7 and 8. Therein it will be seen that each carriage assembly, either 26 or 28, comprises an elongated, transversely oriented axle 30 on which a wheel 32 is rollably mounted. The wheel 32 may be made of hard rubber, a hard plastic, metal, wood or the like, and is provided with a bore 34 therethrough for receiving the axle 30. If desired, bearing means, not shown, may be positioned in the bore 34 in a conventional manner. A rigid, elongated channel member, generaly designated by the reference character 36 is integrally secured to the axle 30 for minimizing the bending thereof. Each channel member 36 is comprised of a pair of laterally spaced apart legs 38 and 40 and an integral, intermediate leg 42 connecting the laterally spaced apart legs 38 and 40. The axle 30 is positioned on and extends the length of the intermediate leg 42. In the embodiment illustrated, the ends of the legs 38 and 40 that are opposite the intermediate leg 42 and are provided with flanges 44 and 46, respectively.

There is further included, in the carriage assembly 36, a wheel cover generally designated by the reference ccharacter 48. As shown best in FIG. 8, each wheel cover 48 at least partially covers the upper portion of its respective wheel 32 and is comprised of a first, partially cup-shaped section 50 having an inwardly directed end face 52 and an outwardly directed, circumferential portion 54. There is further provided a second, partially cup-shaped section 56 having an end face 58 that is integral with the circumferential portion 54 of the first wheel cover section 52. The second wheel cover section 56 is further provided with a circumferential portion 60 that is integral with the end face 58 thereof. As shown for example in FIG. 8, the end face 52 and the circumferential portion 54 of the first cup-shaped section 50 is positioned relatively closely to the inner end face and the circumferential surface of the wheel 32 while the circumferential portion 60 of the second cup-shaped section 56 is spaced radially outwardly of the circumferential surface of the wheel 32.

The carriage assembly 36 further includes means for limiting axial movement of the axle. One form of structure for providing this function is also shown in FIG. 8. The means for limiting axial movement of the axle comprises a slot 62 formed in the intermediate leg 42 of the channel 36 at each end thereof. An annular member 64 is rigidly secured to the axle 30 at assembly and is at least partially contained within the slot 62. As shown in FIG. 8 the left hand end face 66 of the annular member 64 bears against the end wall 68 of the slot 62. A stop member 70, in the form of a gusset, is formed integrally with the end face 52 of the first cup-shaped section 50 of the wheel cover 48 and, at assembly, bears against the right hand end of a face 72 of the annular member 64. The extremities of the axle 30 are threaded in a conventional manner in order to receive fasteners such as cap nuts 74.

It will be appreciated that the intermediate wall 42 and the flanges 44 and 46 limit bending moments of the channel 36 in a horizontal plane while the sidewalls 38 and 40 thereof limit bending moments on the channel 36 in a vertical direction. Since the annular member 64 is rigidly secured to the axle 30 and is captured between the end wall 68 of the slot 62 and the gusset 70, axial movement of the axle 30 is prevented. The cap nut 74, which is threaded on the axle 30 prevents axial movement of the wheel 32.

Turning now specifically to FIG. 9, there is shown one possible form of structure for securing the carriage assembly 36 to the underside of the body portion 12 although it should be clearly understood that other means may be employed. Prior to sealing the plastic body portion 12 into an air-tight envelope, a support plate 74 is secured to the inside surface thereof by any suitable means such as with an adhesive. Fastener means such as rivets 76 and washers 78 are then used, together with holes 80 in the flanges 44 and 46, to secure the underside 12*a* of the body portion 12 to the carriage assembly 36. Care, of course, must be taken to assure a tight seal. Accordingly, a suitable sealing compound should be applied to the outer end of the rivets 76.

From the foregoing it will be appreciated that an improved, rollable inflatable toy has been provided. The toy is rigid enough, when inflated, to support the weight of a child and may be rolled about by the child on a hard surface. The toy may be very inexpensively mass produced using conventional techniques and materials. For example, the hollow inflatable body portion may be made of any suitable plastic material while the channel members that define the front and rear carriages may be stamped or bent from a rigid metal such as steel or the like. The present invention provides a combination of inflatability and rollability, which combination of features was absent from the prior art.

The embodiment of the invention, particularly disclosed here is presented merely as an example of the invention. Other embodiments, forms and modifications of the invention coming within the proper scope of the appended claims will, of course, readily suggest themselves to those skilled in the art.

What is claimed is:

1. An inflatable, rideable toy comprising: a hollow body portion including a forward end, a rearward end and an intermediate central portion that is shaped so that a human may sit thereon; means for inflating said hollow body portion; a rollable forward carriage assembly secured to the underside of said hollow body portion proximate said forward end thereof; and a rollable rear carriage assembly secured to the underside of said hollow body portion proximate said rearward end thereof, at least one of said carriage assemblies including a substantially rigid and transversely extending support member integral with the underside of said hollow body portion, at least one wheel rotatably carried by said support member, an axle member interconnecting said wheel to said support member, and wheel cover means integral with said support member for at least partially covering upper portions of said wheel, said wheel cover means comprising a first partially cup-shaped section having relatively inwardly disposed face surfaces integral with circumferential surfaces which are spaced from outer surfaces of said wheel, said hollow body portion when inflated to a predetermined pressure being sufficiently rigid to substantially support the weight of said human without said intermediate central portion touching the surface upon which said toy rides.

2. The toy according to claim 1, wherein said forward and said rear carriage assembly each comprise: an elongated, transversely oriented axle; a wheel mounted on and proximate each end of said axle for rotation relative to said body portion; and rigid, elongated channel means integral with said axle for minimizing the bending thereof.

3. The toy according to claim 2, wherein each said channel means is defined by a pair of laterally spaced apart legs and an integral, intermediate leg connecting said spaced apart legs, said axle being positioned on and extending the length of said intermediate leg.

4. The toy according to claim 3, wherein said spaced apart legs each include an outwardly directly, elongated flange.

5. The toy according to claim 1, wherein said wheel cover means further comprises a second partially cup-shaped section having inwardly disposed face surfaces integral with said circumferential surfaces of said first section, said second, partially cup-shaped section further including a circumferential portion integral with said face surfaces thereof.

6. The toy according to claim 5, wherein said face surfaces and said circumferential surfaces of said first cup-shaped section are positioned relatively closely to inner end face and outer circumferential surfaces of said wheel, respectively.

7. The toy according to claim 5, wherein said circumferential surfaces of said second cup-shaped section is radially spaced outwardly from said circumferential surfaces of said first cup-shaped section.

8. The toy according to claim 1, further comprising limiting means including a slot formed in said support member at each end thereof; an annular member secured to said axle inwardly of each end thereof, said annular member being at least partially contained within said slot and arranged so that one transverse end face thereof bears against an axially inner end wall of said slot; a stop member carried by said channel means and arranged to bear against an opposite transverse end face of said annular member; and fastener means for retaining said wheels on said axle.

9. The toy according to claim 1, wherein said inflating means is a tubular stem integral with said body portion for providing fluid communication with the interior thereof and means for closing said stem after said body portion has been inflated.

10. The toy according to claim 1, wherein said body portion includes an integral handle adapted to be held by the human when the human is seated on said body portion.

11. A toy according to claim 1, wherein said forward and rearward carriage assemblies are movable toward and away from one another under the influence of shifting of the weight of said human.

12. A toy according to claim 1, wherein the successive shifting of weight of a human riding upon said body portion will result in progressive movement of the toy along the surface upon which said carriage assemblies are supported.

* * * * *